US010251420B2

(12) United States Patent
Ognibene

(10) Patent No.: US 10,251,420 B2
(45) Date of Patent: Apr. 9, 2019

(54) BOTANICAL CARTRIDGE FOR SMOKING DEVICE

(71) Applicant: David Scott Ognibene, San Francisco, CA (US)

(72) Inventor: David Scott Ognibene, San Francisco, CA (US)

(73) Assignee: David Ognibene, San Francisco, CA (US)

( * ) Notice: Subject to any disclaimer, the term of this patent is extended or adjusted under 35 U.S.C. 154(b) by 250 days.

(21) Appl. No.: 15/426,203

(22) Filed: Feb. 7, 2017

(65) Prior Publication Data

US 2018/0220705 A1 Aug. 9, 2018

(51) Int. Cl.
*A24F 47/00* (2006.01)
*A24F 9/00* (2006.01)

(52) U.S. Cl.
CPC ..... *A24F 47/004* (2013.01); *A24F 9/00* (2013.01)

(58) Field of Classification Search
USPC ..... 131/329
See application file for complete search history.

(56) References Cited

U.S. PATENT DOCUMENTS 4,114,629 A * 9/1978 Sedlacek ..... A24D 1/02 131/301
5,269,327 A * 12/1993 Counts ..... A24F 47/008 128/200.14
6,164,287 A * 12/2000 White ..... A24F 47/008 131/194
8,678,013 B2 * 3/2014 Crooks ..... A24F 47/006 131/271
9,380,813 B2 * 7/2016 McCullough ..... A61M 15/06
10,076,139 B2 * 9/2018 Monsees ..... A24F 47/008
2005/0109358 A1 * 5/2005 Wheeler ..... A24C 5/46 131/365
2010/0108081 A1 * 5/2010 Blevins Joyce ..... A24B 15/282 131/274
2010/0300467 A1 * 12/2010 Kuistila ..... A24B 15/165 131/328
2013/0037041 A1 * 2/2013 Worm ..... A24F 47/008 131/329
2015/0367366 A1 * 12/2015 Edwards ..... A23G 1/50 239/302

FOREIGN PATENT DOCUMENTS

AU 2012202592 B2 * 7/2015 ..... A24D 3/04
WO WO-2014132182 A2 * 9/2014 ..... A24D 1/002

* cited by examiner

*Primary Examiner* — Nina Bhat

(57) ABSTRACT

A botanical cartridge for a smoking device with a die cut sheet of paper coated with oyster shell powder. The sheet is approximately L shaped where the bottom portion of the L shape is folded into an accordion shape and the tall portion of the L shape is rolled into a cylindrical shape with the accordion shape trapped within the cylindrical shape forming a breathable base surface. The tall portion of the L shape has a leading edge and a trailing edge that, when rolled, overlap each other and are adhered together by standard means. A preferred embodiment includes the height of the tall portion of the L shape can vary depending on the amount of botanical material to be inserted in the botanical cartridge.

8 Claims, 4 Drawing Sheets

BOTANICAL CARTRIDGE FOR SMOKING DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of heat proof cartridges and more specifically to a botanical cartridge for a smoking device. The preferred embodiment relates to a portable vaporizer devices.

The present invention is related to the field of smoking devices that are commonly used to release the active ingredients of plant material or to release therapeutic compounds. A healthier alternative to smoking, vaporizers heat the material at a much lower temperature when compared to traditional smoking so that the active compounds contained in the plant material produce an aromatic vapor instead of smoke. Rather than burning the plant material, which can produce numerous harmful by-products, this vapor contains virtually zero particulate matter and significantly reduced noxious gases. By avoiding combustion and resulting smoke, the user is able to achieve the same desired effects without the harmful side-effects of smoking.

There are two basic types of vape devices. One is a larger device that is usually placed on a table top and is specifically set up to ensure that the botanical contents do not burn, and the other is a smaller portable device where the botanical material is placed in a chamber with a heating element at the base of the chamber. The portable device has the advantage of being discrete and easily transportable, but has the disadvantage of possibly igniting the portion of the botanical material that is in close contact with the heating element, thereby potentially causing unwanted smoke and or other noxious gases.

This is a deficiency in the portable type vape units. Additionally, the user must measure and fill the chamber of the portable unit with botanical material which can be a messy and inaccurate process. Finally, the chamber of the portable vape unit must be cleaned regularly because of the buildup of sticky residue in the chamber after use.

BRIEF SUMMARY OF THE INVENTION

The primary object of the invention is to provide a single use botanical cartridge for a vape device that allows a user to quickly and easily fill the vape device with botanical material.

Another object of the invention is to provide a single use botanical cartridge for a vape device that allows the botanical material to be vaporized without combusting the botanical material.

Another object of the invention is to provide a single use botanical cartridge for a vape device that allow the heating chamber of the vape device to remain clean and free from burnt residue.

A further object of the invention is to provide a single use botanical cartridge for a vape device that can be pre-filled with a measured amount of botanical material.

Yet another object of the invention is to provide a single use botanical cartridge for a vape device that is biodegradable.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a botanical cartridge for vape device comprising: a die cut sheet of paper coated with oyster shell powder, said die cut sheet being approximately L shaped, said bottom portion of said L shape folded into an accordion shape, said tall portion of said L shape rolled into a cylindrical shape with said accordion shape strapped within said cylindrical shape, and said tall portion of said L shape having a leading edge and a trailing edge that, when rolled, overlap each other and are adhered together by standard means.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
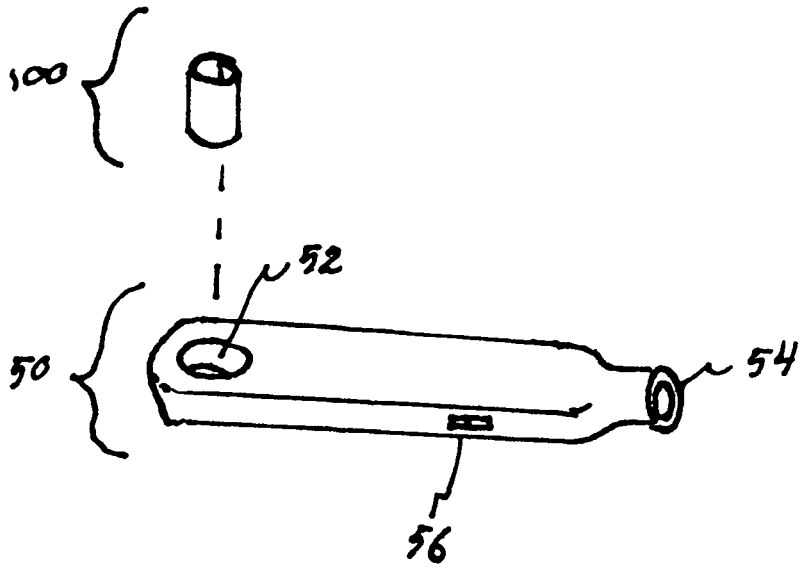
FIG. 1 is a perspective view of the invention about to be inserted into a vape device.

Referring now to FIG. 1 we see a perspective view of the invention 100 ready to be inserted into the heating chamber 52 of the portable vape pipe 50. The vape pipe includes a heating element within the heating chamber 52, a mouthpiece 54 to draw vapor out of and an on off switch 56.

The unique cartridge 100 is made from a sheet of biodegradable paper coated with oyster shell powder to make it heat resistant. The oyster shell powder is also biodegradable and safe for human contact.

Figure 2:
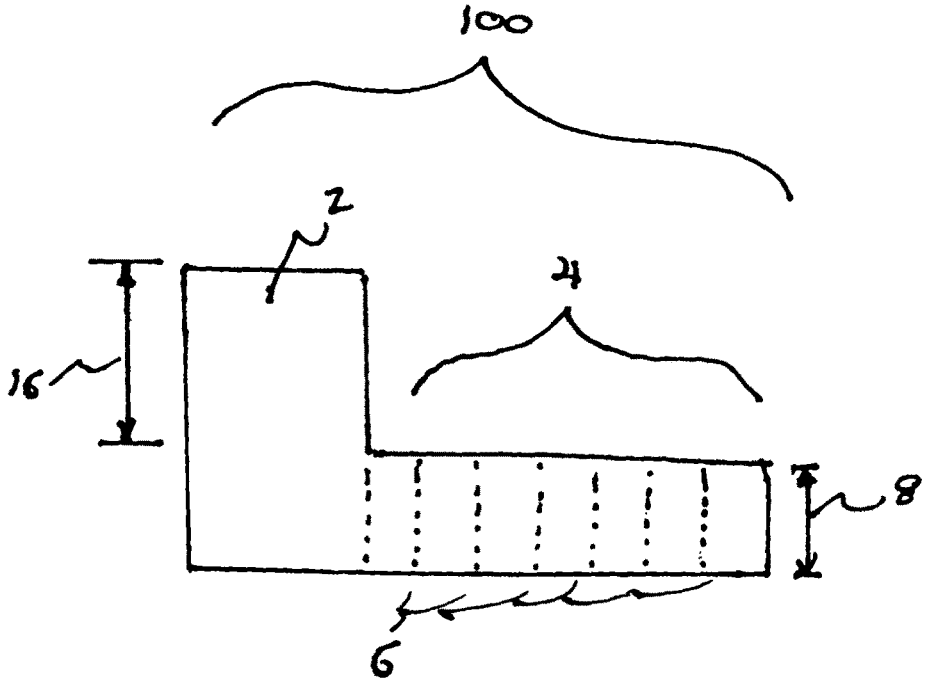
FIG. 2 is a plan view of the sheet before folding
Figure 3:
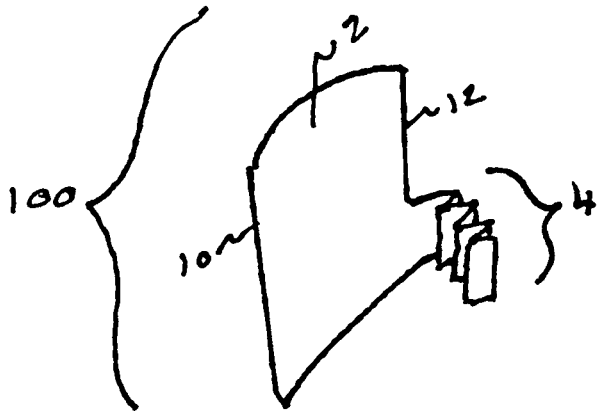
FIG. 3 is a perspective view of the sheet folded and partially rolled.
Figure 4:
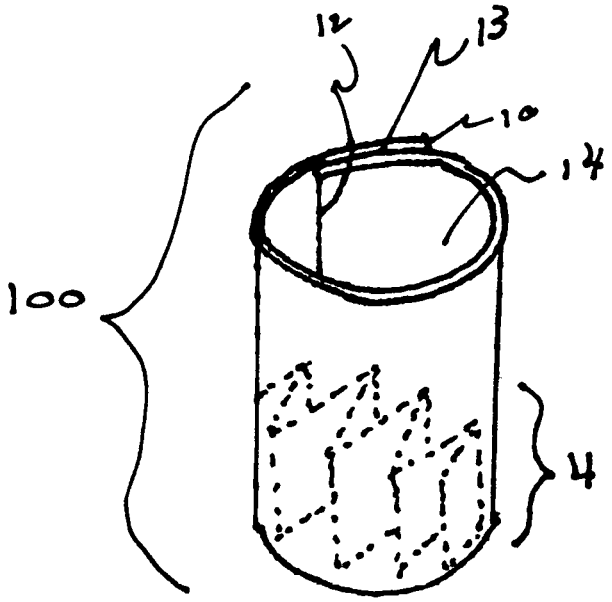
FIG. 4 is a perspective view of the sheet in a fully folded and rolled condition.

FIG. 2 is a top plan view of the cartridge in its flat, unrolled condition. The paper is die cut into an L shape where the tall part of the L shape 2 is rolled to create a cylindrical shape and the lower part of the L shape 4 is scored 6 to create an accordion shape as shown in FIG. 3. The tall portion 2 is then rolled so that the leading edge 10 can overlap 13 the trailing edge 12 to create a cylinder as shown in FIG. 4. The overlapped portion 13 is held together by standard means such as adhesive, or double sided tape.

FIG. 4 shows the accordion member 4 in dotted lines. The remaining space above the accordion area 14 is available for botanical materials or other materials such as herbs, waxes, oils or juices. In the case of oils or juices, they would be applied to a breathable, and absorbable material so that they would not drip onto the heating element of the vape device. Because the botanical material is held away from the heating element by the accordion member 4, the material is less likely to combust, but rather vaporize thereby eliminating the harmful smoke and particulate matter that results from incinerating paper or botanical material. The height 8 of the lower portion of the leg 4 is approximately three sixteenths of an inch as shown by dimension line 8 in FIG. 2. The height of the tall portion of the L as shown by dimension line 16 can vary depending on the amount of botanical material that the user wishes to store within the cylindrical portion 14. The cartridge 100 has a semi rigid quality because of the inclusion of the impregnated oyster shell powder, allowing for easy filling without the cylindrical shape collapsing. The cartridge 100 can either be pre-filled with botanical material, or it can be sold empty so that individuals can load their own material of choice. These filled cartridges 100 allow the user to refill the vape device quickly without the user's fingers getting sticky and botanical material falling outside of the desired chamber 52 location. The process of loading the cartridge into the vape device is quick and discreet. The current design also allows the user to pre-heat the vape device before inserting the cartridge 100, making for a quicker vape experience. The chamber 52 of the vape device 50 remains clean because the botanical material is never in contact with the walls of the chamber 52.

In the broadest interpretation of the present invention, the paper used for the cartridge 100 can be either coated or uncoated and can also be used in electronic or non-electronic smoking devices. Additionally, the cartridge shape can vary to be square, ovoid or any other geometric shape.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. botanical cartridge for a smoking device comprising:

a die cut sheet of paper coated with oyster shell powder;

said die cut sheet being approximately L shaped;

said bottom portion of said L shape folded into an accordion shape;

said tall portion of said L shape rolled into a cylindrical shape with said accordion shape trapped within said cylindrical shape; and said tall portion of said L shape having a leading edge and a trailing edge that, when rolled, overlap each other and are adhered together by standard means.

2. A botanical cartridge for smoking device as claimed in claim 1 wherein the said cartridge can be inserted into the chamber of a portable vaporizer device.

3. A botanical cartridge for smoking device as claimed in claim 1 the upper portion of said cartridge can be filled with botanical material.

4. A botanical cartridge for smoking device as claimed in claim 2 wherein the lower portion of said cartridge contains said accordion shape which creates a space between the heating element of said vaporizer and said botanical material stored in said upper portion of said cartridge.

5. A botanical cartridge for smoking device as claimed in claim 1 wherein the height of said tall portion of said L shape can vary depending on the amount of botanical material to be inserted in the said botanical cartridge.

6. A botanical cartridge for a smoking device as claimed in claim 1 wherein said paper coated with oyster shell powder is fire retardant and allows said botanical material to be vaporized without the said botanical cartridge or the said botanical material to combust.

7. A botanical cartridge for a smoking device as claimed in claim 1 wherein said smoking device can be preheated before inserting said cartridge.

8. A botanical cartridge for a smoking device as claimed in claim 1 wherein said cartridge is biodegradable.

* * * * *